US007918768B2

(12) United States Patent
Rogozinski

(10) Patent No.: US 7,918,768 B2
(45) Date of Patent: Apr. 5, 2011

(54) MAN—MACHINE INTERFACE IMPROVEMENT

(76) Inventor: Joseph Rogozinski, Ramat Gan (IL)

( * ) Notice: Subject to any disclaimer, the term of this patent is extended or adjusted under 35 U.S.C. 154(b) by 2143 days.

(21) Appl. No.: 10/806,231

(22) Filed: Mar. 23, 2004

(65) Prior Publication Data

US 2006/0035758 A1 Feb. 16, 2006

Related U.S. Application Data

(63) Continuation of application No. PCT/IL02/00778, filed on Sep. 19, 2002.

(30) Foreign Application Priority Data

Sep. 24, 2001 (IL) ..... 145591

(51) Int. Cl.
*A63B 22/06* (2006.01)

(52) U.S. Cl. ..... 482/57; 482/51; 482/80

(58) Field of Classification Search ..... 482/51, 482/57–65, 80; 280/294
See application file for complete search history.

(56) References Cited

U.S. PATENT DOCUMENTS

| | | | | |
|---|---|---|---|---|
| 2,749,771 | A | 6/1956 | Pearl | |
| 3,422,701 | A | 1/1969 | Boisis | |
| 5,199,324 | A | 4/1993 | Sain | |
| 5,634,382 | A | 6/1997 | Fan | |
| 2007/0093360 | A1 * | 4/2007 | Neff et al. | 482/8 |

* cited by examiner

*Primary Examiner* — Glenn Richman
(74) *Attorney, Agent, or Firm* — Dekel Patent Ltd.; David Klein

(57) ABSTRACT

A pedal assembly for a bicycle, including a pedal, a crank arm having an axis of rotation of the crank arm, and a variable attachment device that attaches the pedal to the crank arm at an angle of inclination with respect to the axis of rotation of the crank arm, wherein the variable attachment device enables changing the angle of inclination with respect to the axis of rotation of the crank arm without disassembly of the pedal from the crank arm.

10 Claims, 15 Drawing Sheets

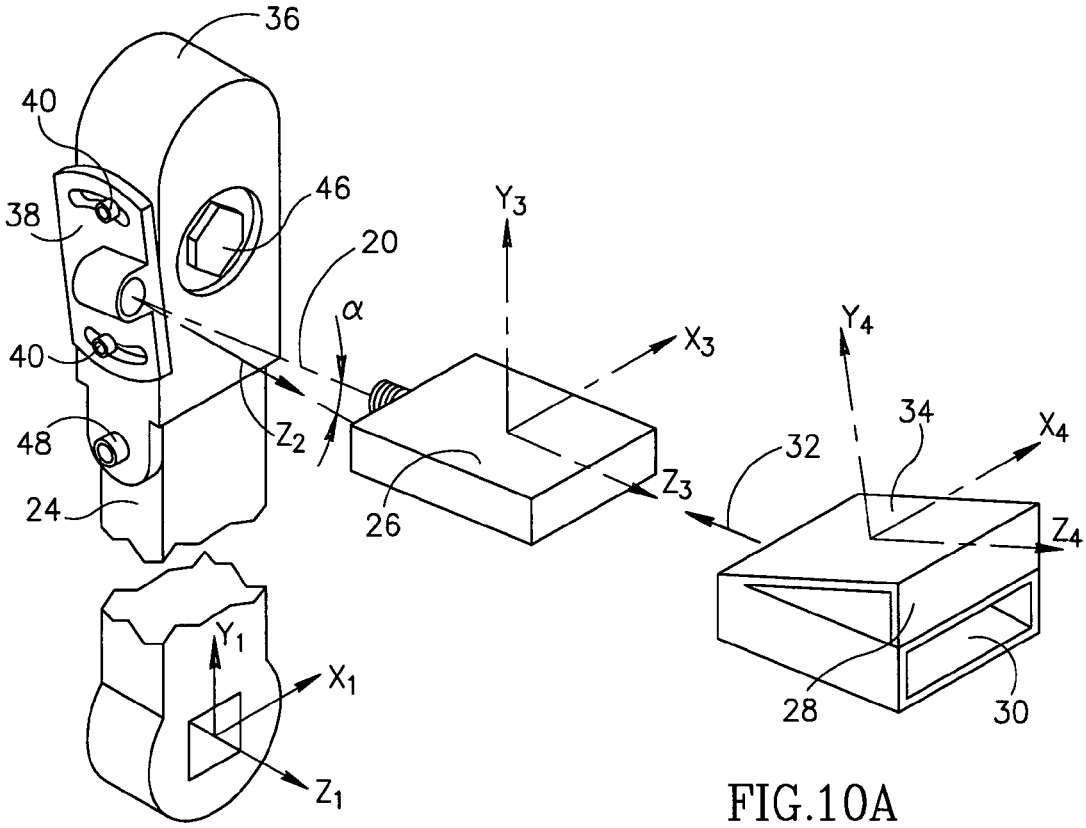
FIG.9
FIG.10A
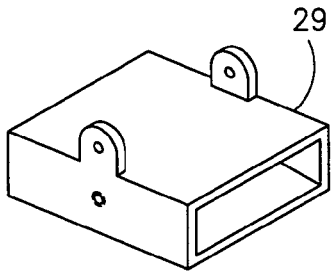
FIG.10B
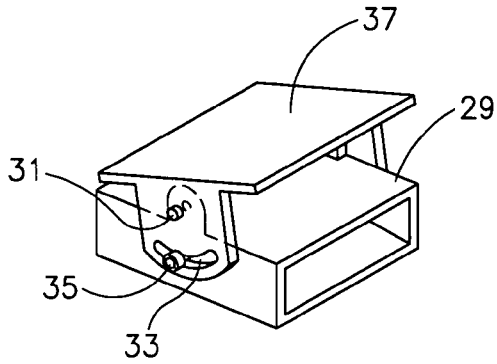
FIG.10C

MAN—MACHINE INTERFACE IMPROVEMENT

CROSS-REFERENCE TO RELATED APPLICATIONS

This application is a continuation of PCT Patent Application, PCT/IL02/00778, filed Sep. 19, 2002, which is incorporated herein by reference.

FIELD OF THE INVENTION

The present invention relates generally to systems intended to aid sportsmen, people undertaking physical fitness exercises and handicapped persons, in introducing additional movements to those customarily used in such activities, thus achieving better results.

BACKGROUND OF THE INVENTION

The systems currently used in fitness gyms, the bicycles serving many sportsmen and a large selection of equipment (designed for rehabilitation of) the handicapped—mainly provides movement of the human limbs in two dimensions. Alternatively, it can be said that the person using them does operate them, in principle, only with two bi-dimensional movements. The major drawbacks of the above mentioned systems are in that they do not provide exercise to many joints of a person in diverse directions, and thus their efficiency is limited.

Bicycles riders (hereinafter: "rider"), and in particular the professionals, activate their feet in a movement such that the knees would hover over the pedals, and at times in a manner such that the knees deviate inwards (towards the bicycles' frame). A large percentage of these riders have to make an effort in order to maintain their knees in this position. The pedals provided in accordance with the embodiment of the present invention, force the knees inwards and thus increases the efficiency of their pedaling, hence enhancing their chance of winning in competitions.

Existing pedals do not support this kind of movement—hence the rider has to train himself to execute these movements, without any "assistance" from the pedals.

A pedal with a ±3° tilt angle (manufactured by LOOK Company) is known in the market. However, those tilts do not apply to tilting the axis of the pedal relative to the arm, hence they are different from the tilt applied in the present invention.

The following patent documents are believed to be relevant to the subject matter of the present invention: U.S. Pat. Nos. 4,893,523; 5,142,938; 5,449,332; 5,628,710; 6,241,639; 6,270,446.

SUMMARY OF THE INVENTION

The patent shows also a pedals based system whose major mechanical components differ from the existing ones.

In many systems of the invention the difference is implemented by deflecting the axle of the pedal in an angle relative to the state existing in bicycles and also in exercising equipment in fitness rooms, and thus we induce an additional activation of various joints of the human body.

Preferably everywhere where we state "additional movement" to the bi-dimensional movement, we are talking of an additional type of movement that can be performed in a different linear direction, angular directions or any combination of the two.

Preferably everywhere where we state bi-dimensional movement, we imply a movement made primarily in a plane.

Preferably, when we mention a sportsmen, a person in a fitness gym, a patient, a handicapped person or similar potential users, then by denoting one of them we include all the others as if they were explicitly mentioned.

Preferably, wherever fitness gym equipment was cited, the principles disclosed above and hereinunder said equipment will also be usable by handicapped sportsmen and others.

Example: when such subjects as bicycles are presented we include under this title also fitness bicycles in fitness gyms. The various axes systems, are presented, preferably, mainly in order to explain our treatment of the angles. Occasionally, the origin of the axes is shifted from one place to another in order to clarify certain points in the different drawings. The various angles, e.g., $\alpha$, $\beta$, $\gamma$, $\delta$ etc., are presented in the various drawings, preferably on the right hand side of the bicycle, and preferably, other systems, in order to show and explain their relations to the equipment and the axes system.

Preferably, by replacing (mutatis mutandis) "right" with "left" in the systems, the meaning of the relations for the left hand side are clear and hold as well for the left hand side.

Preferably, for the sake of generality, the values of the angles in the right hand side and the left one, do not have to be necessarily equal. In the various drawings, the values of $\alpha$, $\beta$, $\gamma$, $\delta$ etc., may preferably be different. In most systems presented in the various drawings, preferably, the addition of a movement is mainly of the angle.

The angles $\alpha$, $\beta$, $\gamma$, $\epsilon$ etc. may also be, preferably, negative angles, and in other instances, preferably, also even zero.

In experiments that we conducted, we noticed strong and pronounced influence effects for the cases of negative a in bicycles, plus positive $\gamma$ (horizontal at HOUR 12). Note that it was proved that this is the best for competition riders, as without such an arrangement their knees tends to stray away (i.e., outwards) from the center line when pedaling.

When we refer in the text to "foot", it includes, preferably, the bottom part (sole) of the foot, the thigh, lower leg, as well as a shoe, a competition bicycle rider's special shoe, and any other definition of a person's step on a surface.

Similarly, wherever we refer in the text to "an energy source", it includes, preferably, also "a laser beam", and/or a laser pen, or a light beam, or an ultra sound or radar source/beam or simply "a beam".

In all above cases, even if only one of the above possibilities is mentioned, it should be taken to cover, preferably, one or all the above mentioned possibilities.

Moreover, when the reference is made in the singular voice, of a foot, pedal, shoe, lower leg, sole of the foot or thigh or any other similar item, as an explanation of a given side (e.g., right) the explanation covers as well the other side, with the mutatis mutandis variations when discussing the other side (left).

When we mention bicycle, the intention is preferably, a reference to regular bicycles, professionals' competition bikes, gym room bicycles—and all preferably, as the case may be. Preferably, when referring to cardboard, a bristol cardboard, wall, floor, ground, target or a target (plate) on which marks can be made, even if only one of the above possibilities is mentioned, it should be taken to cover, preferably, one, all or any combination of the above mentioned possibilities.

In most of the above examples we presented the various deflections through rotations applying to systems that preferably are executing full turns. Preferably, the statements above apply also to rotational movements that do not complete full (360°) turns and/or to any cyclic or rotational movements when preferably, mechanical transmissions may be used to assist their operation. Preferably, many such pieces of equipment are in use in the various fitness gyms. Preferably, the invention also relates to the mode by which the movements of a person is measured using optical equipment and a laser beam, while some of them are, preferably, linlked with a computer. Preferably, bio-feedback and various displays preferably enable the person to observe his movements and preferably to improve them. Preferably, the invention also relates to diverse methods that preferably enable to vary the angle of the pedal with ease.

BRIEF DESCRIPTION OF THE DRAWINGS

The present invention would be understood better and more fully appreciated by referring to the following detailed description taken in conjunction with the drawings, in which:

FIG. 9: Shows a system for deflecting the pedal to various angles.

FIGS. 10A, 10B, 10C: Show systems for varying the stepping angle on the pedal.

FIG. 17A: Shows a system for machining the arm for.

FIG. 24A: Shows a device for measuring the angle of the pedal's arm (at hour 3).

DETAILED DESCRIPTION OF PREFERRED EMBODIMENT

Reference is now made to FIGS. 1, 2, 3, 4 and 5, which illustrates bicycles 2, constructed and operative in accordance with a preferred embodiment of the present invention.

Purpose of the System: intended to, preferably, deflect the right hand pedal 4 and left hand pedal 6 by an angle $\alpha$, in order to change the stepping angle of the rider when he pedals.

An orthogonal axes system $X_1$, $Y_1$, $Z_1$ is linked to the body of the bicycle. The $X_1$ axis is parallel to the main, namely central, plane of the bicycle, preferably directed forward and approximately parallel to the ground. The $Y_1$ axis is located on the same plane, and directed upwards. The direction of the $Z_1$ axis is as presented in FIGS. 2 and 5.

Preferably, in the majority of cases, the main goal of presenting systems of axes, as they will be "created" and defined later, is to present various angles, hence there is no great importance to the manner of defining the origin (point) of the axes.

Occasionally, as we will find it convenient, we will shift the origin of the axes. The angle $\theta$ defines the angle of right hand arm 8 relative to the $Y_1$ axis.

Figure 2:
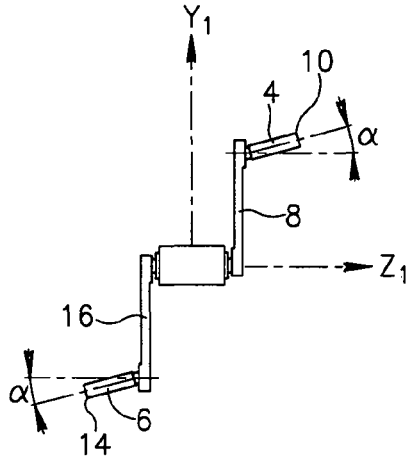
FIG. 2: Shows pedals at a deflected angle.
Figure 3:
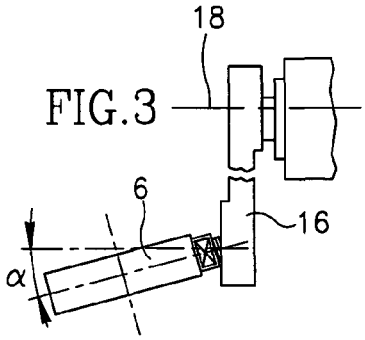
FIG. 3: Shows Left Hand pedal, deflected at the upper position.
Figure 4:
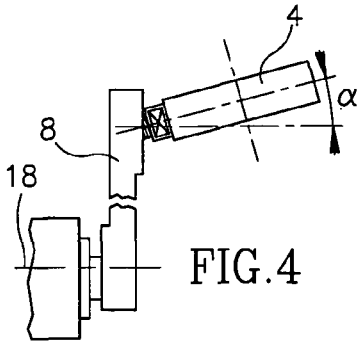
FIG. 4: Shows Right hand pedal, deflected at the lower position.

In FIGS. 2 and 3 it is seen that for right hand arm 8 at its top state, preferably the deflection angle of pedal 4 is a relative to axis Z1. This deflection shall be denoted as "upwards pointing" deflection, because it is presented when the outer end 10 of the pedal was raised upwards.

For left hand pedal 6 the deflection angle $\alpha$ is preferably identical to that of right hand pedal 4.

The outer end 14 of left hand pedal 6 is deflected downwards when left hand arm 16 is at its bottom state.

On pedaling right hand arm 8 from its upper position to bottom position we will receive, preferably, a state in which from upwards angle $\alpha$ at the top position it becomes a at the bottom position (see the position presented in FIG. 2 for the left hand arm 16). Actually, the foot step of the rider shall go in every turn through a $2\alpha$ angle from the upwards deflected position to the downwards deflected position and back to the upwards deflected position.

Around the rotation axis 18, the rotations of the arms that take place are as follows.

Preferably when arm 8 and arm 16 are parallel to the ground, outer end 10 of right hand arm 4 is deflected forwards.

Figure 5:
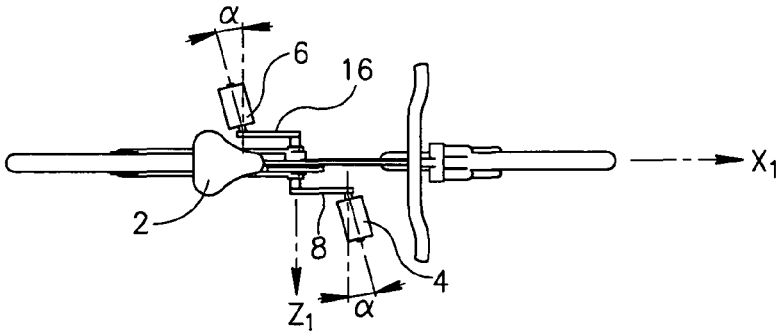
FIG. 5: Shows bicycle, top view.

Applying an explanation similar to the preceding one, it becomes evident that through a complete turn—each pedal executes a $2\alpha$ deflection, as seen in FIG. 5.

Preferably, if we allow the human foot step to slide over the pedal, than this movement will not turn the foot.

If we now lock the rider's foot to the pedal, then also the foot will receive preferably a turning in an angle approaching $2\alpha$ for every complete turn of the pedals.

Preferably we have presented the deflection angle $\alpha$ as identical for the two peals, for the sake of simplifying the explanations. However, the deflection angle of the left pedal may also be different from that of the right one.

Actually, the outcome of introducing the $\alpha$ angle deflections of the pedals results in introducing a new movement of the joints of the foot. This movement is not performed when riding conventional bikes.

Preferably Opposite a angles to those presented above may also be executed.

For example, on the right hand side of FIG. 2, outer end 10 might be deflected downwards instead of upward.

Preferably, in accordance with the reversed deflections, the relative directions of angles $\alpha$ will become opposite to those presented by FIGS. 2, 3, 4 and 5.

Figure 6:
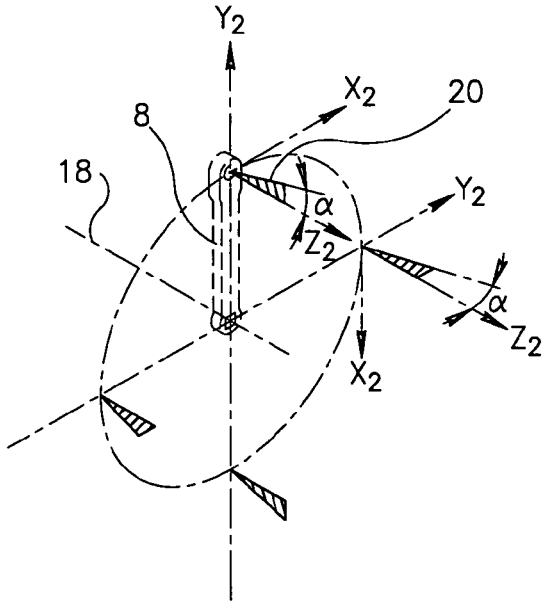
FIG. 6: Shows the deflection of the pedal, at different rotation conditions.
Figure 7:
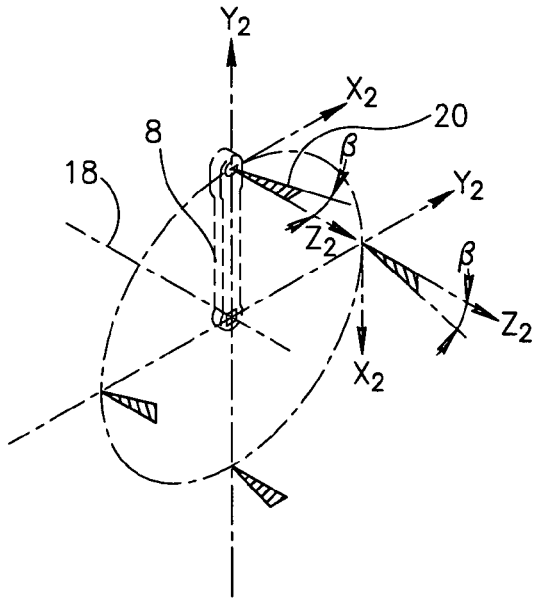
FIG. 7: Shows the deflection of the pedal, at different rotation conditions.
Figure 8:
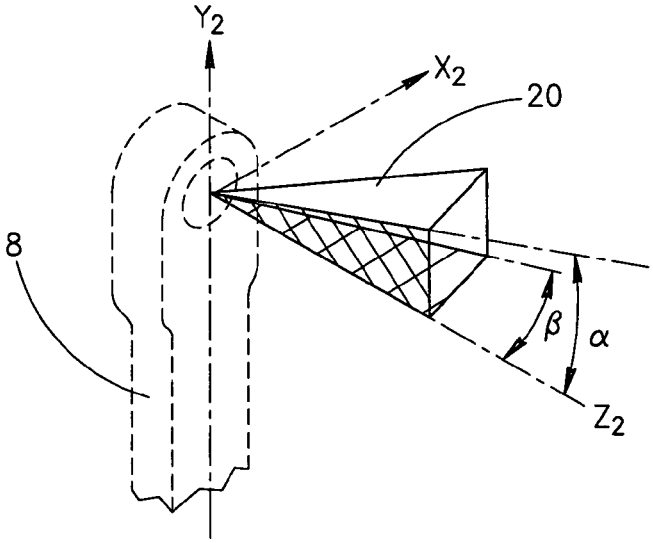
FIG. 8: Shows the deflection of the pedal, with angles coupled in two axes.

Reference is now made to FIGS. 6, 7, and 8 which illustrates right hand arm 8 and various deflections of the main axis 20, constructed and operative in accordance with a preferred embodiment of the present invention.

Purpose of the figures is to present, preferably, the various positions of the main axis 20 for different state of rotations of pedal arm 8.

For presenting this explanation we define ban axes system $X_2, Y_2, Z_2$ coupled to right hand arm 8.

Axis $Y_2$ passes preferably through center of rotation axis 18 and center of the main axis 20.

Axis $X_2$ is directed towards the riding direction where preferably the arm is at its upper position. Axis $Z_2$ is perpendicular to the previous ones. Axes $X_2, Y_2$ are parallel to the plane of axes $X_1, Y_1$.

In FIG. 6 one can see $\alpha$—the deflection of the main axis 20, preferably relative to the $Z_2$ axis in the vertical plane. This deflection varies for every given angular position of the right arm 8 relative to the bicycle 2. The arm's view at its upper position, where $\alpha$ is in a vertical plane is presented in said drawing. When right arm 8 is preferably horizontal, angle $\alpha$ is in a horizontal plane. From the above it can be understood that while rotating, main axis 20 executes movements that can be described as follows: from upper position to horizontal plane—pointing forward; to lower position and thence to horizontal plane-pointing backwards and continuing to the first upper position. The rider's bottom foot, if locked to the pedal (by a strap or otherwise) shall preferably perform the same movements.

In experiments we have noticed that when the foot is not locked to the pedal, we usually obtain an up/down angular movements of the foot but that the horizontal component vanishes (nearly totally) because the foot slides on the pedal. For the private case of $\alpha=0$, we obtain the regular condition as in conventional bicycles, where the added movement of main axis 20 does not exist.

A state of affairs for which the deflection $\beta$ of main axis 20 is preferably in $X_2, Y_2$ plane is presented by drawing 7.

In this case, main axis 20 of right arm 8 points forward when it is in its upper position, and in the horizontal position of right arm 8 axis 20 points downwards. The explanations given regarding drawing 6, help in understanding this point.

A state in which the deflection angle of main axis 20 is a vector defined by the angles $\alpha$, $\beta$ is shown in FIG. 8. The explanations of FIGS. 6 and 7 help in understanding this point.

In the experiments we observed that there is a significant difference in a person's feelings and functions when changing conditions as depicted by FIGS. 6, 7 and 8.

Reference is now made to FIGS. 9, 10A, 10B, 10C, 11 and 12 which illustrates arm 24 as was used for some of the experiments constructed and operative in accordance with a preferred embodiment of the present invention.

Purpose of the system is to enable, preferably, continuous deflection of angle $\alpha$ when conducting experiments. The system also enables fixed deflections of a.

Angle varying fixture 18 enables preferably to add or subtract an angle $\gamma$ as per the user's will.

Preferably, rectangular opening 20 enables mounting angle varying fixture 18 on pedal 26, by inserting as per insertion direction 32. The description in the drawings are for arm pointing upwards. Mounting fixture 18 as presented in FIG. 12 causes upwards deflection of upper plane 34 by angle $\delta$, given by the equation:

$$\delta=\alpha+\gamma$$

where $\alpha$ and $\gamma$ do not have to be necessarily equal.

The angle $\delta$ is the angle between axes Z2 and Z4 when the arm is at [HOUR 12].

As explained earlier, the movement of the main axis 20 for our case is $2\alpha$ (see explanation to drawing 6 relating to the subject of deflections in the vertical direction from the upper position of the arm to the lower one).

For the private case in which $\alpha=\gamma$, we obtain for the upper position a very large deflection $\delta$ of pedal 26, $\delta=2\alpha$ and for the lower position $\delta=-\alpha+\alpha=0$, namely will get a preferably horizontal pedal.

In experiments we conducted using fitness gym bicycles and competitive (professional) bicycles we noticed that it is possible to find and adapt to the user angles $\alpha$ and $\gamma$ that are convenient and optimal for him. In most cases we have found that $\alpha\neq\gamma$ is the convenient situation, where the absolute values of the angles $\alpha$ and $\gamma$ are nearly equal.

Figure 12:
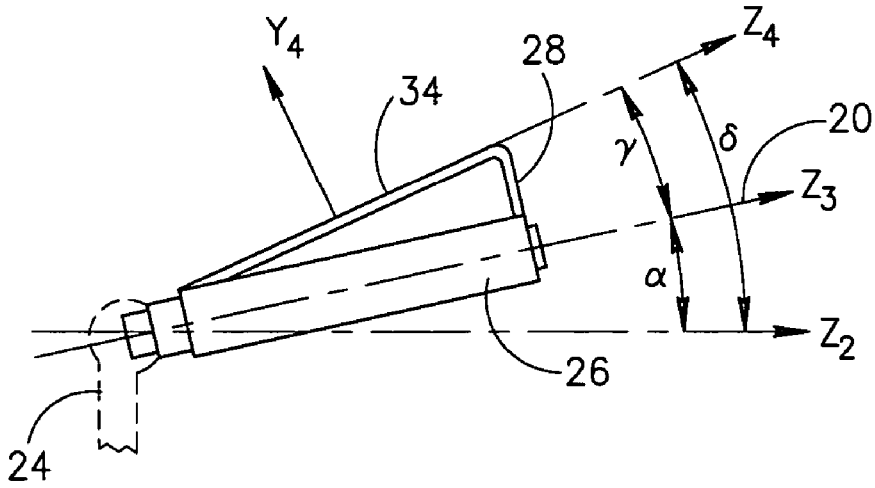
FIG. 12: Shows a pedal deflected at the upper position with an additional angular deflection.

We have found that competition riders generally fit the positions to the arrangement depicted by FIG. 12, where, however, $\alpha$'s sense is opposite to the one shown in the figure, in which angle $\gamma$ is a positive angle but angle $\alpha$ is negative, and where, however, they are nearly equal in size.

It is known that competition riders—pedaling uphill, tend to bend their knees inwards (towards the bike) when he pushes the pedal from the upper position downwards. This state of affairs is often defined is optimal.

It was found that the situation depicted by FIG. 12, implemented in a fitness room, atmosphere, helps imparting a movement to the knee that provides a convenient training to the rider.

Figure 11:
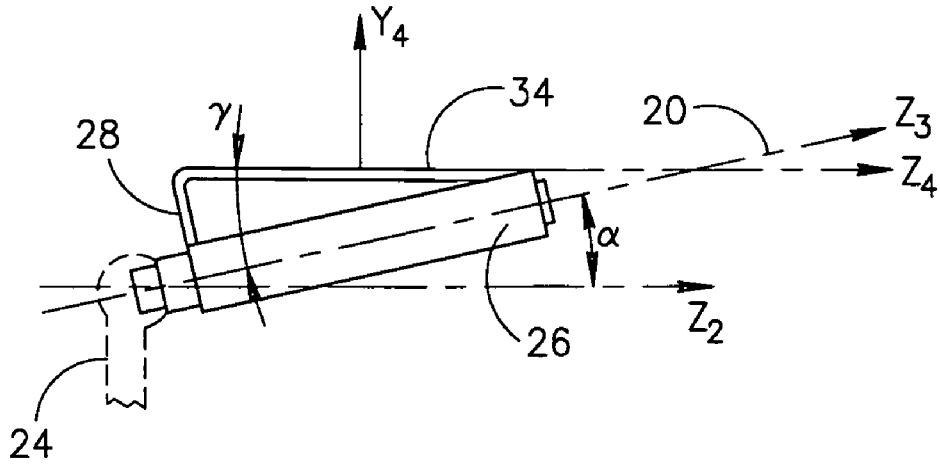
FIG. 11: Shows a pedal deflected at the upper position with an addition that reduces its angular deflection.

In FIG. 11, the angle changing fixture 18 was mounted in a opposite manner than that defined by FIG. 12 for the angle $\gamma$.

Here, in the upper position, angle $\delta$ is preferably horizontal for the private case $\alpha=\gamma$, thus $\alpha-\gamma=0$.

Hence in this case $\delta$ is horizontal in the upper position and deflected downwards by $2\alpha$ at the bottom (for the private case: $\alpha=\gamma$).

We would like to point out the significant differences regarding the tilting of the pedals' upper surface and its function (as exists) in the method used in LOOK Company approach versus the particularly advantageous characteristics of the present invention.

Look's pedals provide the ability to change the surface's angle relative to the pedals' axis by ±3°.

A change of the angle of the surface relative to the pedals' axis is also realized in patents U.S. Pat. Nos. 6,241,639 and 5,449,332.

However, said change in above mentioned patents is accomplished in a manner such that throughout the pedaling activity the angle of the upper surface remains constant relative to the ground's (floor) surface and/or relative to the pedals' Z1 axes (see FIG. 2).

In contra distinction, in our patent, when angles $\alpha \neq 0$ and $\gamma \neq 0$ are generated, we obtain a preferably continuously changing angle of the upper surface of the pedal for any angular condition of the arm while pedaling.

The change also occurs in the fore and aft direction, and hence it is possible to obtain a method wherein the conditions $\alpha \neq 0$ and $\gamma \neq 0$ with the variations of the angle at any angle of the pedals' arms.

Figure 24A:
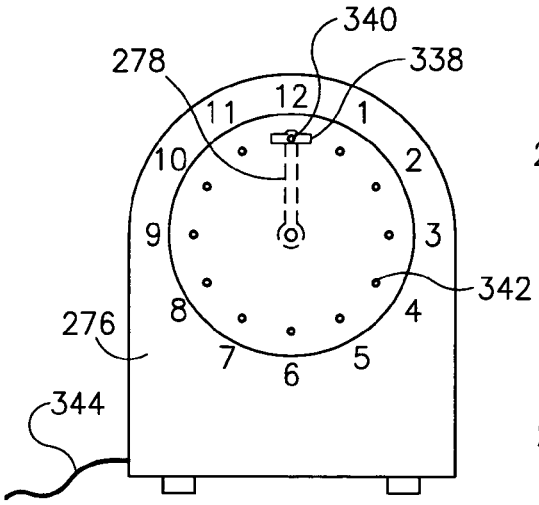
FIG. 24A: Shows a device for measuring the angle of the pedal's arm (at "hour 12", as marked).
Figure 24B:
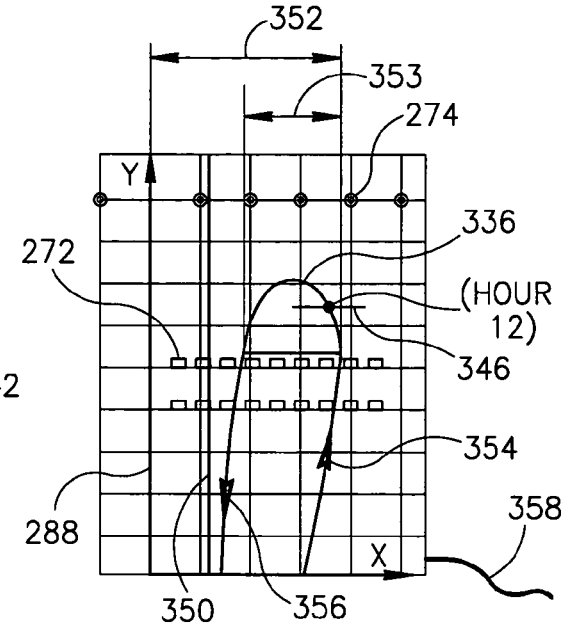
FIG. 24B: Shows a display panel with a record of the rider's movements (at hour 12).

To recapitulate—when in our experiments, without our patent pedal, we introduced for example a state in which $\alpha = -3°$ using Look's pedal, we obtained pedaling where the width 353 (see FIG. 24B) is wide, which points at a large sideways movements of the knee together with an extremity large distance 352 in FIG. 24B, whose significance is a knee far away from the bicycle's center line (which is not good for the riders).

Simultaneously, we conducted experiments with our patent pedals using different angles of the pedals, knees' states and diverse pedaling speeds ran by the same riders that participated in the Look pedals experiments.

When we introduced, for example, an angle $\alpha = -3°$ and $\gamma = +3°$ (which bring the pedals' upper surface to a horizontal state, namely $\delta = 0$) we noted immediate improvement of the width 353 which turned out to be VERY NARROW, namely showing a "stabile" knee, not straying sideways from the efficient and benevolent center line together with achieving an extremity distance 352 very near to the bicycles center thus achieving pedaling with knees staying above the pedal (in the center's vertical plane).

These results were consistent and were obtained for different loads (watts), various pedaling and bicycles' speeds. Moreover, the same phenomenas were duplicated hence for riders in the field as well as for experiments ran in fitness clubs—for those whose natural tendency has been to "throw" the knees outwards.

Thus we are entitled to claim that our embodiment provides a totally different method then those based solely on tilting the pedals' upper surface, culminating in higher efficiency and enabling the riders to ride at higher speeds, as was mentioned earlier when comparing the differences versus the case of the other patents.

It was found in experiments that it was possible to have patients after orthopedic surgery use fitness bicycles and adjust them so that that a movement would be limited to the bottom of the foot. In wider range of activation it was possible to exercise the knees, too, and in cases where $\alpha$ and $\gamma$ were made very large, it was possible to pass movement all the way to the pelvis.

Preferably, typical values of $\alpha$ and $\gamma$ in above mentioned experiments were combinations of 0°, 5°, 10°, 15°, 20°.

It will become easier to comprehend the systems of axes presented in the drawings after we have preferably explained the functional aspects of the systems.

Figure 1:
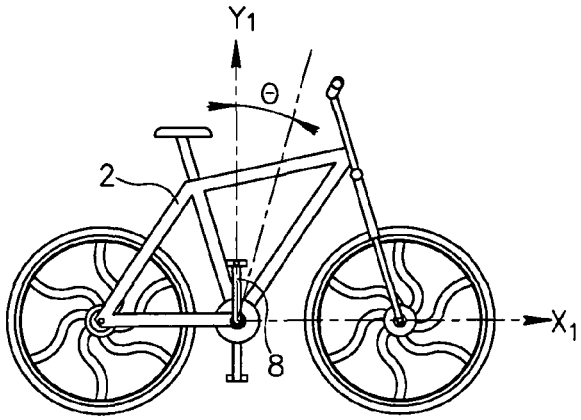
FIG. 1: Shows the bicycle.

The axes system $X_1, Y_1, Z_1$ was explained in FIGS. 1, 2 and 5.

An axes system where $Z_2$ appears was explained in FIGS. 6, 7 and 8.

The axes system $X_3, Y_3, Z_3$ is coupled to pedal 26. For the preferably upper position of arm 24 we shall define directions as follows.

$Z_3$ is deflected upwards by angle $\alpha$. $X_3$ is directed forwards and preferably parallel to the $X_1, Y_1$ plane.

$Y_3$ is perpendicular to $X_3, Z_3$ and its direction is as defined in FIG. 9.

Let us define a new system of axes $X_4, Y_4, Z_4$ which is coupled to the angle changing fixture 18.

$Y_4, Z_4$ are preferably in the $Y_3, Z_3$ plane.

$Z_4$ is deflected by angle $\gamma$ relative to axis $Z_3$ (the direction of $\gamma$ in FIG. 11 is different from its direction in FIG. 12).

$X_4$ is perpendicular to $Y_4, Z_4$ in the direction seen in FIG. 10.

When sliding between the pedal and a person's (bottom of the) foot is allowed, the major rotation angle shall preferably be around the $Y_3$ axis, defined in FIG. 9, or around axis $Y_4$ as defined in drawings 10, 11 and 12. Below (see FIG. 14B) we will refer to axis $Y_3$, preferably as it is employed by a rider pedaling with angles and shoes as used by the competition riders.

Let us describe several parts that served us during the experiments, preferably for mounting an intermediate part on arm 24.

In FIGS. 11 and 12 we omitted most parts, and left only those which were important for the functional description.

As a step preceding the experiments, we removed the existing bike pedals in order to install our system. Rotating base 38 was connected to intermediate part 36 where it is already mounted on a rotation axis (not seen in the figure) which is also connected to intermediate part 36.

The coupling is done using two screws, which are inserted via two "banana slots" 44.

An intermediate part 36 is mounted on arm 24. A screw 46 fastens the intermediate part 36 to arm 24 when it is inserted into a thread made at the end of arm 24. Two screws 48 are fastened to arm 24 in order to strengthen the intermediate part 36.

Pedal 26 is screwed unto rotating base 38 and tightened.

Adjusting the desired angle is preferably executed by opening two screws 40, rotating the rotating base to the desired angle, an re-tightening using screws 40.

In some experiments, the banana slots were replaced by an intermediate part with several bores. This enabled us to go over from deflection angle zero to other pre-selected angles.

In FIGS. 10B and 10C, an arrangement for preferably changing angle $\delta$ within a continuous range is shown. This is obtained by preferably changing angle $\gamma$ in a continuous manner.

The angle is changed around rotation axis 21.

A banana slot 33 enables the rotation. A locking screw 35 locks the base to a variable angle 37, after the desired angle was fixed.

Inter alia, a preferably base to variable angle 19 can also provide the possibilities shown in FIGS. 11 and 12.

Figure 13A:
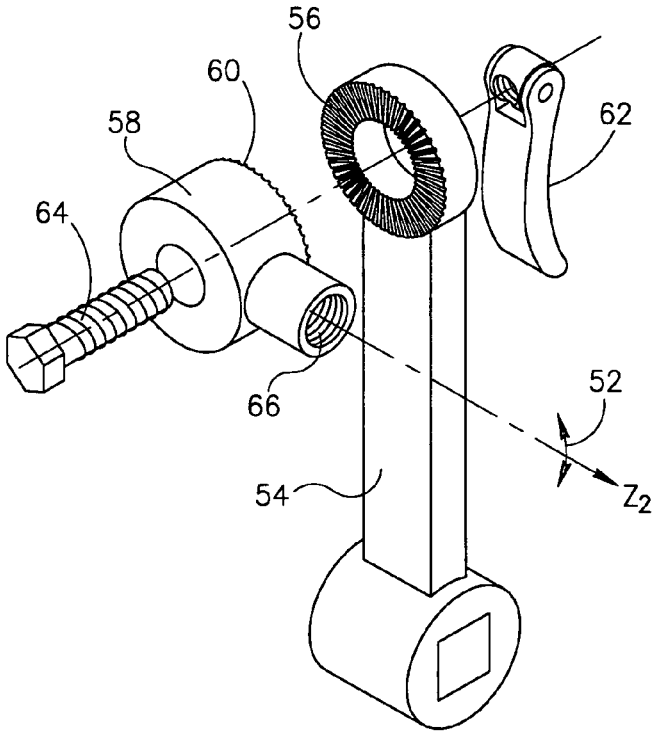
FIG. 13A: Shows a pedal's arm that enables various angular deflections of the pedal.
Figure 13B:
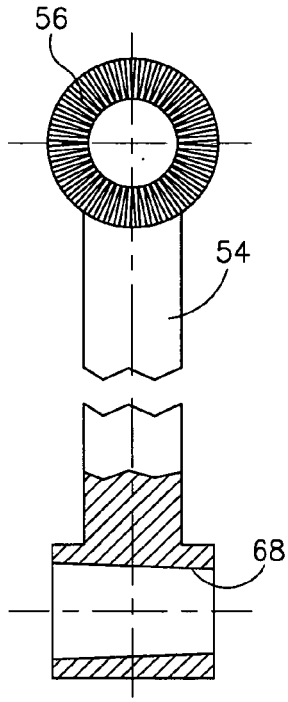
FIG. 13B: Shows a pedal's arm that enables deflecting the pedal.

Reference is now made to FIGS. 13A and 13B which illustrates a fixture for deflecting pedals constructed and operative in accordance with a preferred embodiment of the present invention.

Purpose of the system is preferably to enable convenient and fast manner for deflecting a pedal. Adjustment of the pedal deflection ($Z_2$ axis) is preferably done to directions 52 relative to the arm. Teeth 56 on arm 54 fit teeth 60 on rotating part 58 to approximately the desired angle and tightening arm 62. Tightening arm 62 pulls screw 64 and thus tightens and strengthens the rotating part 58 relative to arm 54.

Arm 62 has an eccenter similar in design to those used in airplanes, which is well known and understood.

Thread 66 is intended for connecting the pedal.

A preferably square hole which is preferably conical is used for connecting arm 54 to the bicycle.

Figure 14A:
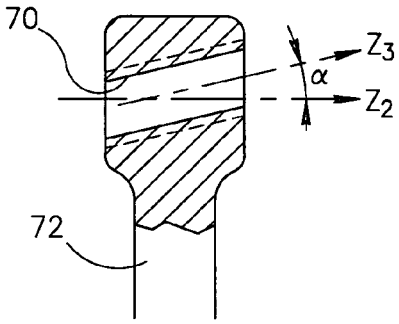
FIG. 14A: Shows a pedal's arm with a single deflection angle.
Figure 14B:
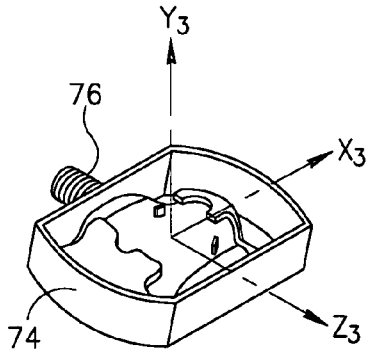
FIG. 14B: Shows a pedal for competition bicycles.

Reference is now made to FIGS. 14A and 14B which illustrates preferably professional's and competitive bike's arm and pedal, constructed and operative in accordance with a preferred embodiment of the present invention.

Purpose of the system is preferably to reduce the weight added to the bicycle as a result of the devices affecting the pedal's angle.

Preferably this subject is very important for professional riders and even more for competition riders.

Preferably, by employing the previously mentioned devices it is possible to find for the rider the α, β angles or their combination best suiting him and preferably his requirements (see FIGS. 6, 7, 8).

After the angle was selected, a bore is drilled and threaded 70 in the arm 72 at the selected angle (FIG. 14A). The angle α relative to axis $Z_2$ that causes deflection of axis Z3 is presented in the figure. Any other angle, preferably a combination of α and β may be used.

A professional's pedal 74 is preferably screwed unto thread 76 into arm 72. An arrangement that enables the shoe of a competition bike's rider to turn around axis $Y_3$ relative to pedal 74 is known. There, if the rotation of the shoe is large the shoe would separate from the pedal 74. The arrangement is intended for mounting and/or removing the shoe.

In our patent-part of this rotation is obtained by angle α when "our" arm is very near to being horizontal. It is possible to undertake mechanical arrangements that will help in getting a range secure from this unwanted shoe-pedal separation. The details of this arrangement is not presented here explicitly.

As an example: there are arrangements such that when a rotating part excutes an angular rotation, a part next to it will perform only fraction of said rotation. For example, using pins inside Banana slots. As for the added weight. Actually we did not add any weight relative to that existing in competition bicycles.

Figure 15:
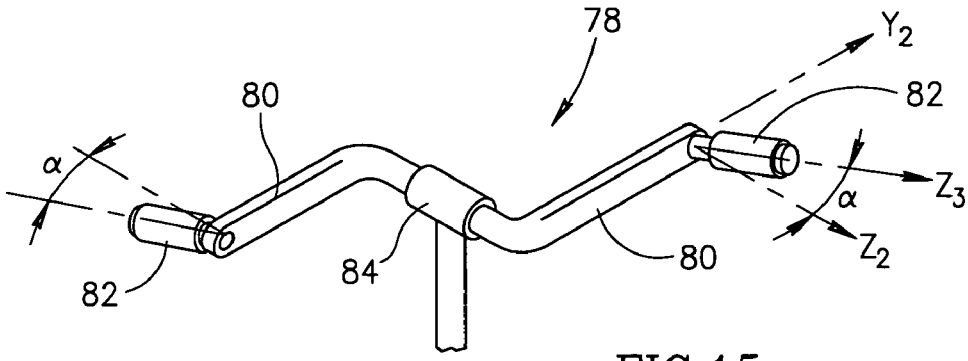
FIG. 15: Shows a deflected set of pedals, (to be) operated by hand.

Reference is now made to FIG. 15 which illustrates hand pedals 78, constructed and operative in accordance with a preferred embodiment of the present invention.

Purpose of the system is preferably to enable movement of various parts of the hand and/or move them using various instruments/equipment. In the known systems angle α equals zero. In our system, as presented by FIG. 15, there is an angle α between axes Z2, Z3. Due to this angle α, we introduce additional movement to the joints of the hand/arm. FIG. 15 refers schematically only to presenting the functions of arms 80 and handles 82.

Upper joint 84 of the hand pedal 78 may preferably represent various systems, among them: for a system in a fitness gym, it might preferably represent a counter load system to the exerciser. In another case it might stand for preferably an electrical generator activated by arms 80. As cited elsewhere, other angles and directions might be preferably selected instead of the cited ones.

Figure 16A:
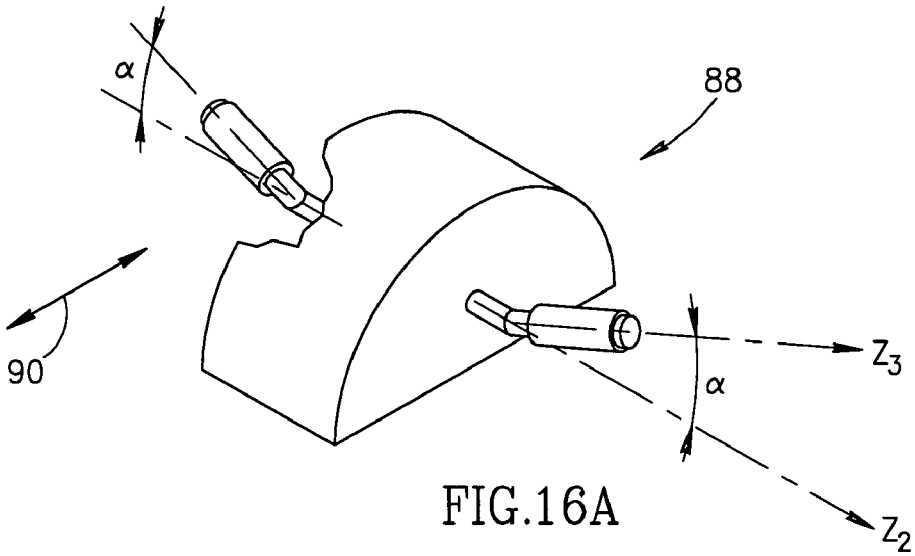
FIG. 16A: Shows a system similar to an A-Slide, with deflected pedals.
Figure 16B:
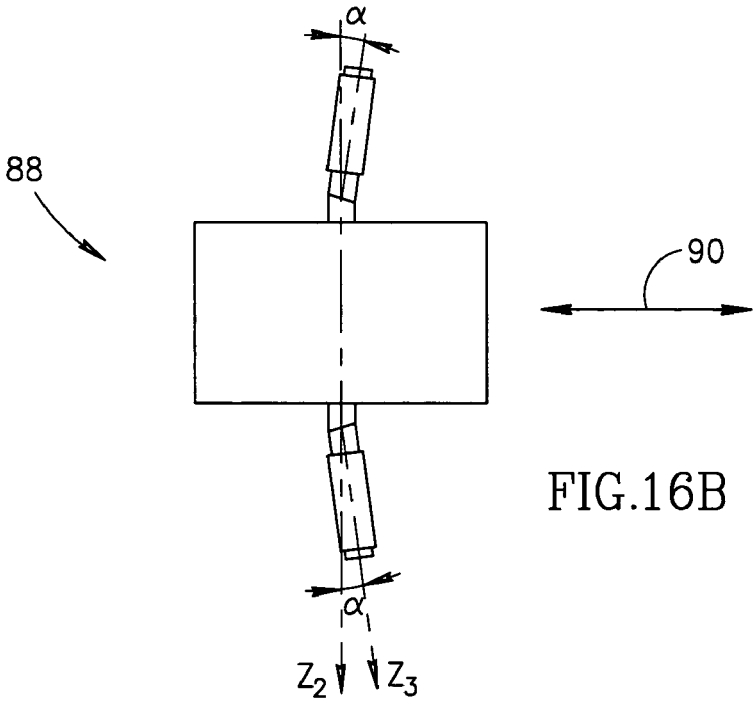
FIG. 16B: Shows a system similar to an A-Slide, top view.

Reference is now made to FIGS. 16A and 16B which illustrates a modified A-Slide 88, constructed and operative in accordance with a preferred embodiment of the present invention.

There is in the market a product which is sold through the buyers' channels and know by its name: A-Slide. The unit rests on the floor, its wheels touching the ground. The equipment is operated by a person's hands, which move the unit in directions of 90 back and forth. Deflecting the handles, preferably by angle α relative to axis $Z_2$, provides the additional movement at the joints of the hand as explained referring to FIG. 15. As for the A-Slide 88 unit, it was found that preferably the α angles should be in the same direction and in the plane defined by $Z_2$, $Z_3$.

Figure 17A:
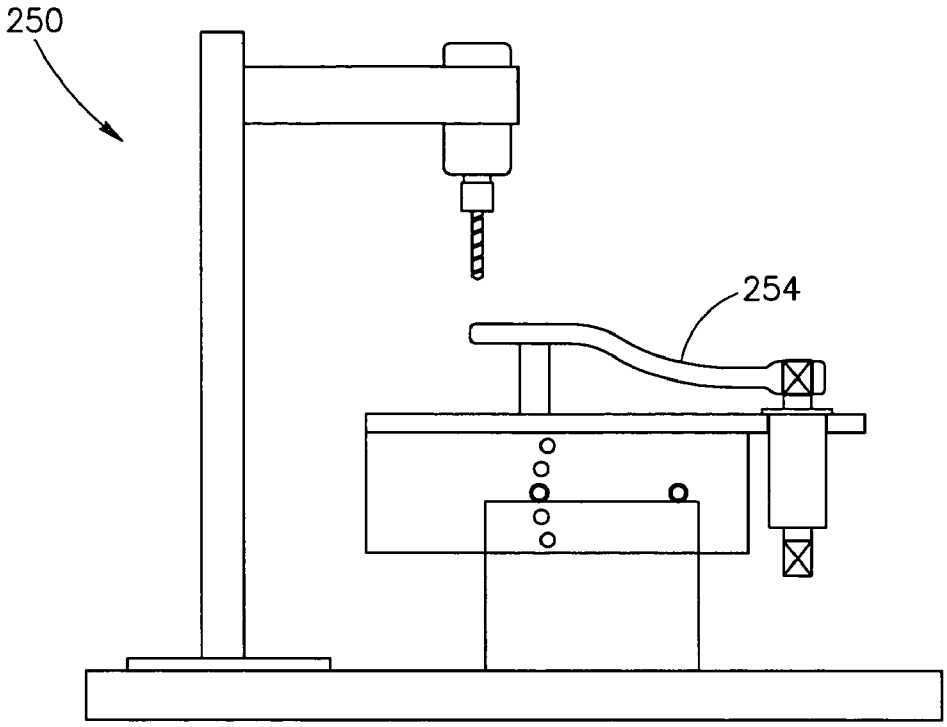
Figure 17B:
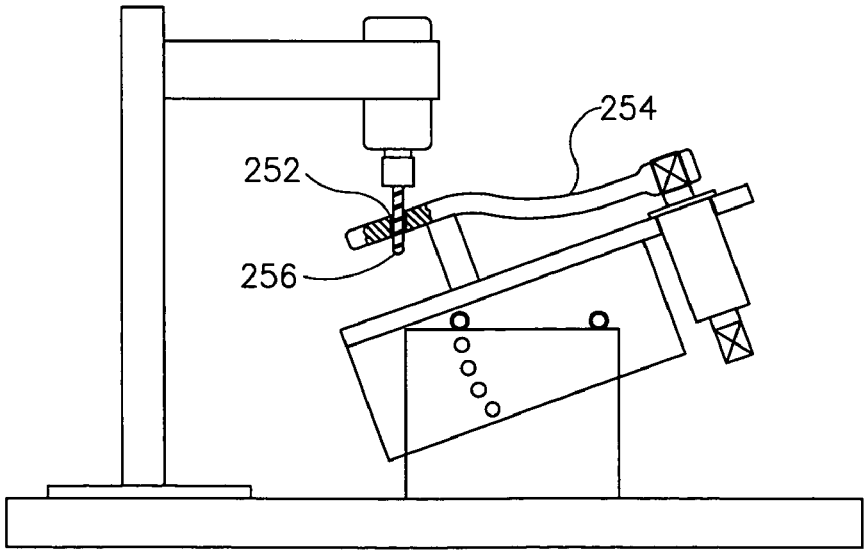
FIG. 17B: Shows the installation in an inclined state.

Reference is now made to FIGS. 17A and 17B that illustrate a device for drilling holes and a tapping 250 for performing a slanted tapping 252 at the end of arm 254.

FIG. 17A depicts the arm 254 in a zero deflection state. FIG. 17B depicts the arm 254 in a slanted state when it is drilled using drill 256. Preferably, the drilling and tapping device 250 is shown depicting a slanted angle in one direction. The drilling can be done at other desired directions. The description is given for clarifying purposes, preferably the same result can be achieved by any other method used in machining processes.

Figure 18:
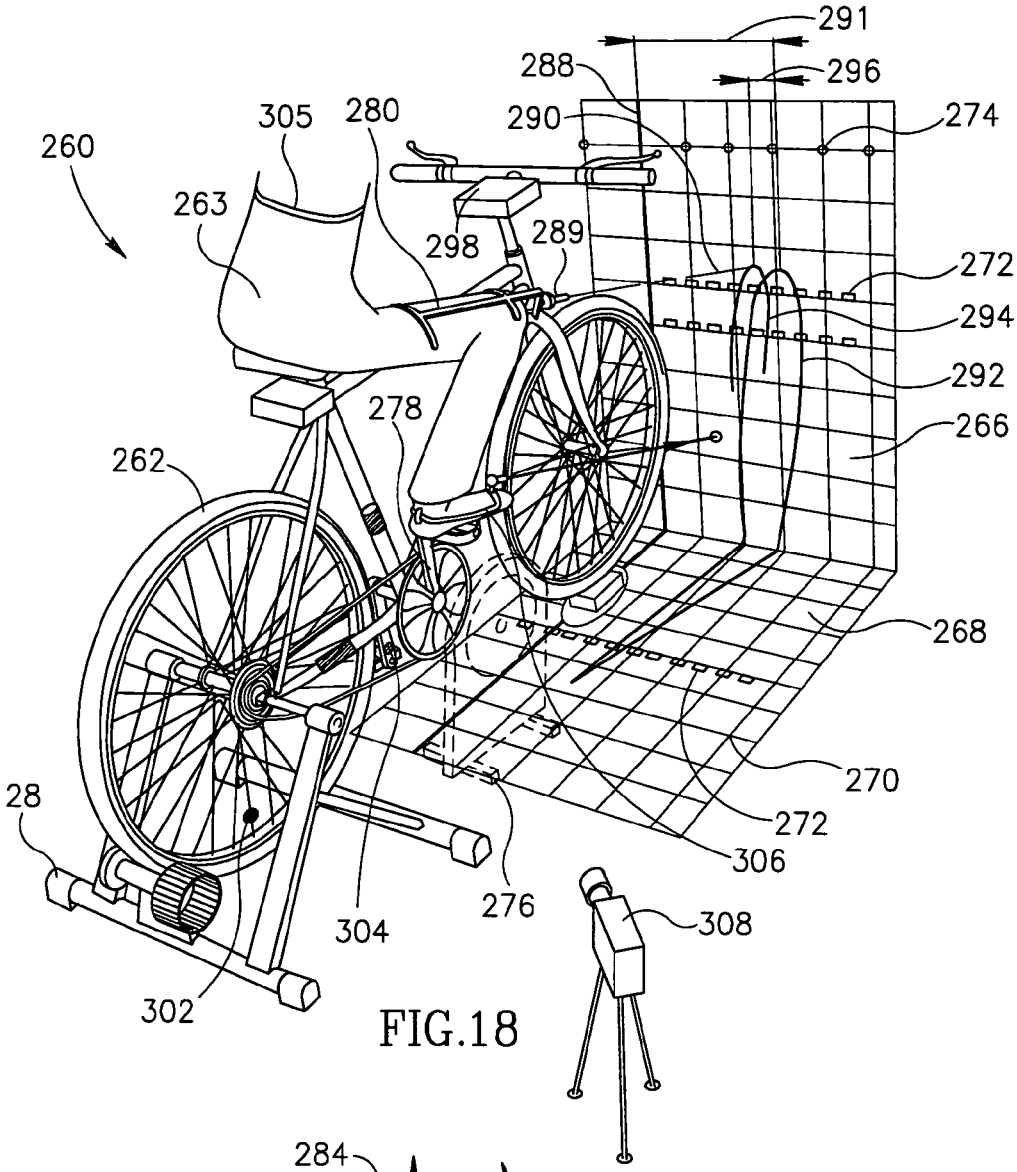
FIG. 18: Shows bicycles mounted on a trainer and a person riding it, where the rider's movements are measured.
Figure 19:
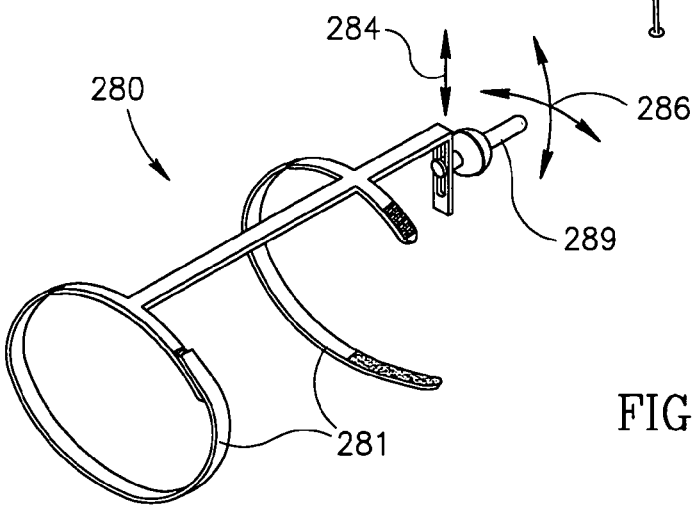
FIG. 19: Shows a device for measuring the movements of a person's thigh performed by using a laser beam.
Figure 20:
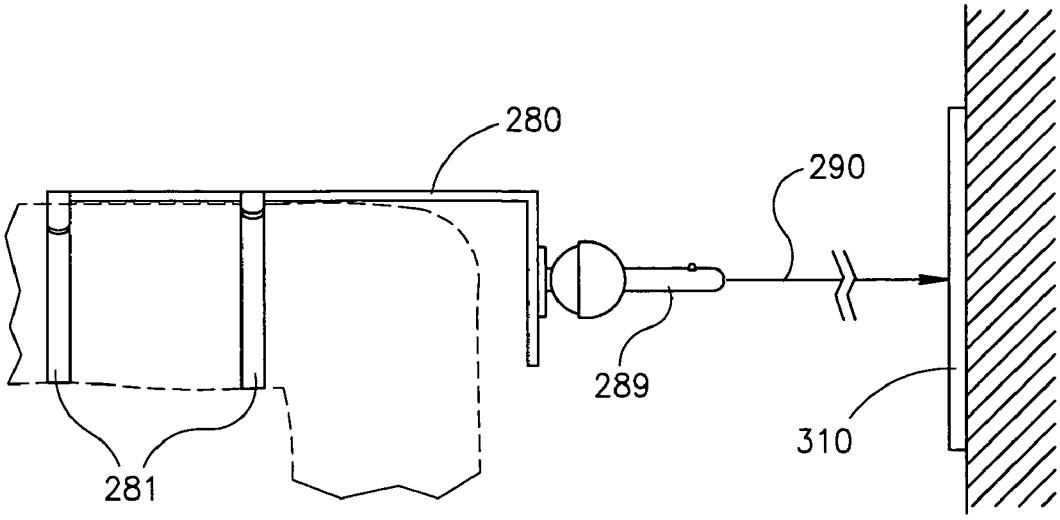
FIG. 20: Shows a device for measuring the movements of the rider's thigh.

Reference is now made to FIGS. 18, 19 and 20, that illustrate a measuring system and a rider 260, constructed and operative in accordance with a preferred embodiment of the present invention.

The bicycles 262 are connected to a trainer 264, and rider 260 is riding them.

Preferably, a vertical bristol cardboard 266 is fixed on a wall and a horizontal bristol cardboard 268 is affixed to the floor.

Preferably, an orthogonal network system 270 is drawn on the cardboard slates, for example the lines being 100 mm apart from each other.

Holes (for sensors 272) are preferably bored in the cardboard, as well as holes (for lamps 274)—as explained later on.

Preferably, device 276 is intended for measuring the arm's angle 278. The device is preferably transparent, so that the location of the arm 278 can be seen.

Preferably, an alternative approach is to employ electrical measurements (see hereinafter).

A device 280 for the thigh is attached to the rider's leg in order to measure the location of the rider's knee when bicycling.

Preferably, Velcro bands 281 are used to attach the device to the thigh. Preferably, a laser pen 282 is attached to the thigh's device 282. Preferably, laser pen 282 (see FIG. 20) can be zeroed in the upwards or downwards directions 284 and in rotational directions 286.

Preferably, the blackened line 288 designates the bicycles' 262 center line. Preferably, the laser beam 290 impinges on the cardboard and/or the sensors 272. Preferably, an external curve 292 expresses the location of the laser beam on the cardboard as drawn when performing actual (real time) experiments.

External space 291 expresses the distance between the blackened line and the upper center of the external curve 292. The internal curve 294 expresses the location of the laser beam on the cardboard as obtained in the experiments following the shift of the knee inwards resulting from variations in the state of the pedals and their adjacent surrounding items in accordance with this invention. Internal space 296 expresses the distance between the blackened line 288 and the upper center of the internal curve 294. A polar system (manufactured by "POLAR" company) was used for the experiments to measure riding speed, power, angular velocity of turning the pedals, measuring heart beat rate and additional parameters.

Several components of said system, are:

Main box 300 connected to bicycles 262;

magnet 302—magnet used for measuring angular velocity of rear wheel arm.

Magnet 304, connected to left arm a of the bicycles, enables measuring the pedaling speed.

Band 305, attached to the rider.

Additional components will be referred to in passing, further below.

Preferably laser device 306 is connected to the shoe and using a laser pen it was possible to display the location of the shoe and displaying on the cardboard the location of the shoe.

A camera 308 was preferably used for photographing the laser beam impact (on the cardboard) during the pedaling time, enabling to analyze the foot movements of the rider.

Preferably, sensors 272 were used for measuring the passage of the laser beam upon them, a devise that enabled inputting this data as a function of the pedal's angular location into the computer's memory.

Only several sensors 272 are depicted in the drawings, but preferably more can be added, moreover it is possible to use any other media that would detect the impact of the light beam on them, and accordingly would generate a signal designating the impact location. Preferably, one of the goals of the experiments was to map variations in the locations of the curves (292, 294) in order to observe the variance between them resulting from changes of the pedals orientation and thus preferably discover the best combination suited ("tailored" for) him.

FIG. 20 shows the spot/curve of laser beam 290 impact on screen 310 that preferably will transfer to a computer the data depicting "impact location as function of time" readings.

Figure 21:
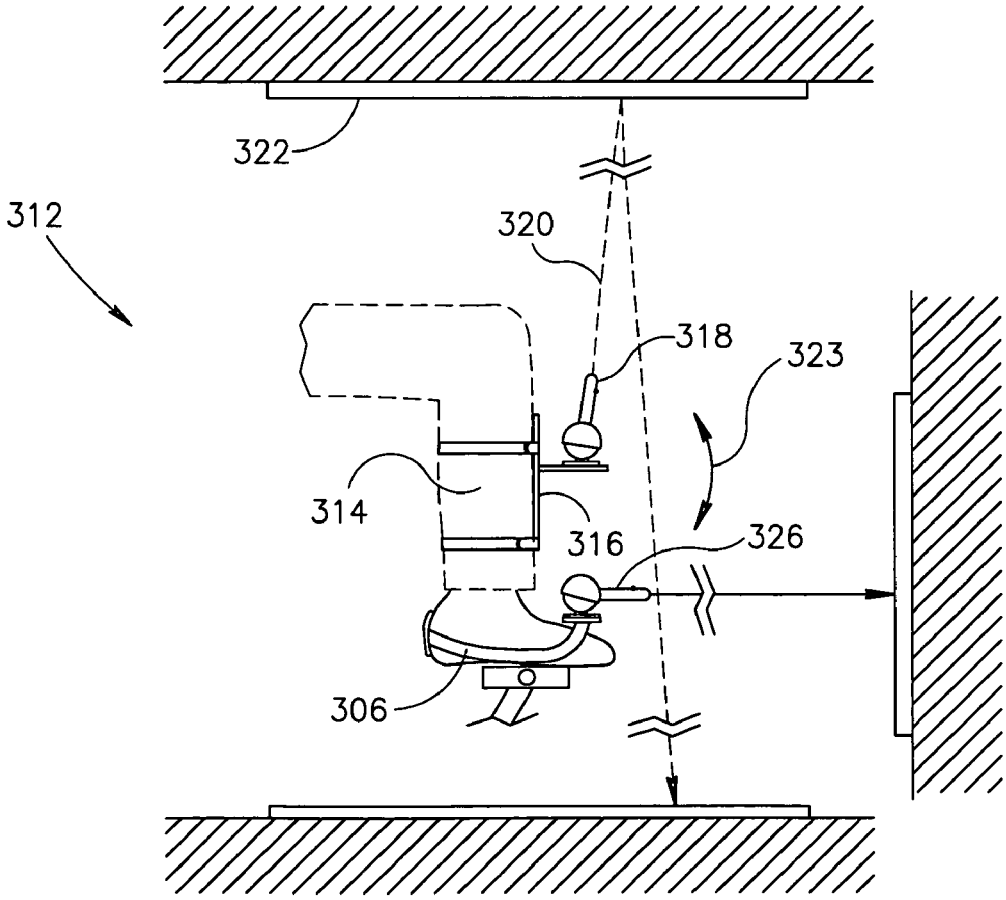
FIG. 21: Shows measurements of the rider's lower leg.
Figure 22:
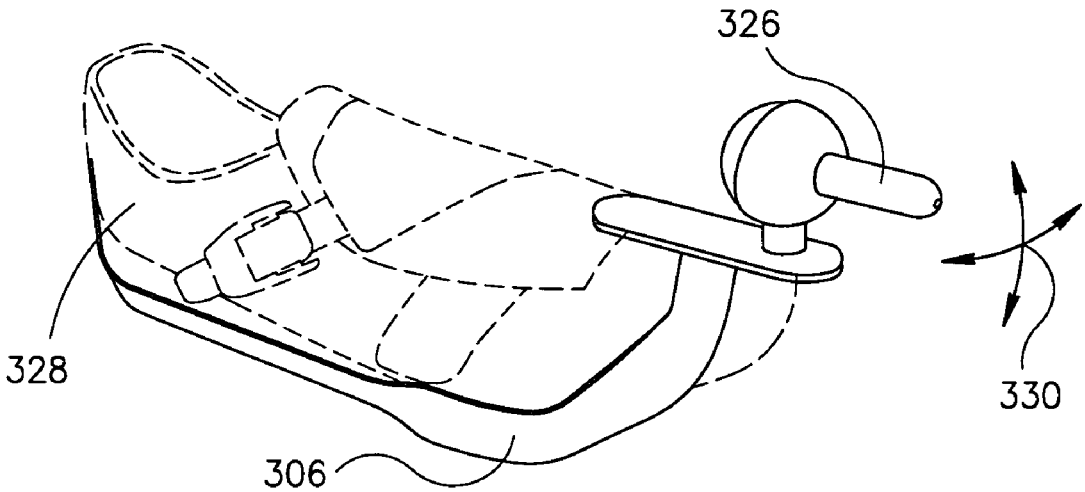
FIG. 22: Shows a device mounted on the rider's shoe, for measuring the movements of said shoe.
Figure 23:
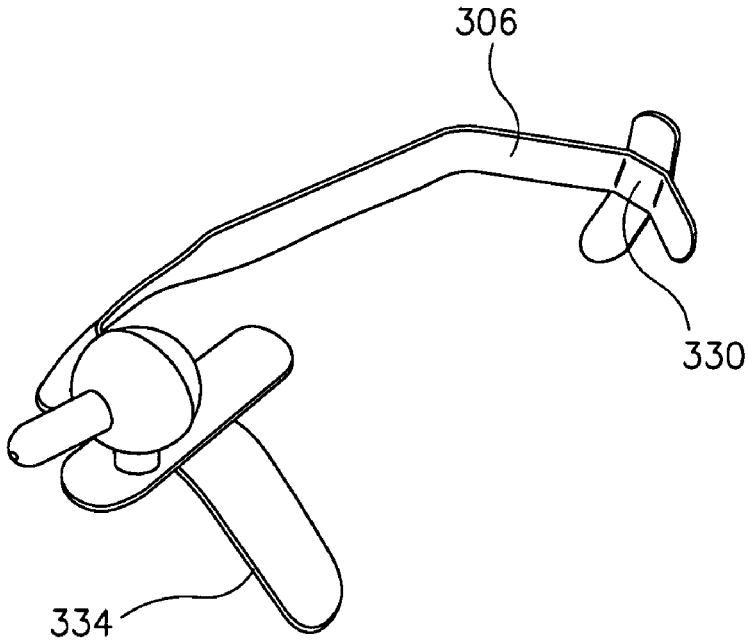
FIG. 23: Shows a device for measuring the movements of the shoe.

Reference is now made to FIGS. 21, 22 and 23 that illustrate measurements of the locations of the shoe and the thigh 312 constructed and operative in accordance with a preferred embodiment of the present invention.

Preferably, lower leg 314 is measured using a vertical device 316 and a laser pen. The laser beam 320 impinges on mirror 322 and is preferably reflected back to cardboard plate 324 laid on the floor. This enables to see and/or draw with ease the curve presenting the movements of the lower leg (see FIG. 21); and in particular relating to the rotation angles 323, on the floor, both in the fore/aft direction of the bikes and sideways (orthogonal to it).

It is possible to preferably replace the mirror 322 by a light-sensitive screen that will transfer the findings directly to a computer (in this case the reflection facet would be meaningless).

Base 306 for laser device mounted on the shoe; its location was described in FIG. 18.

Laser pen 326 that is used here in a similar mode to cases described above.

FIG. 22 shows the mounting of laser device for shoe 306 to the shoe 328. The coupling made preferably be accomplished by using rubber bands (not shown in figure) or any other viable way.

After mounting the laser device on the shoe, zeroing of the device relative to rotational directions 330 is performed. The laser for the shoe device 306 is affixed to the shoe in a unique, nonambiguous condition for the duration of all the experiments. The rear end 330 is preferably attached to the rear of the sportsman's shoe, which in most cases is slightly spherical and centered on it.

The shape of the front end 334 is preferably similar to an upside down V shape and is mounted on the upper part of the shoe and preferably securely attaches the laser device to the shoe. By e.g., using preferably adequate tight rubber bands a reliable tightening is achieved, as was proved in the experiments.

Reference is now made to FIGS. 24A, 24B, 25A and 25B that illustrate a device for measuring the arm's angle 278 and displaying the laser movements 336, constructed and operative in accordance with a preferred embodiment of the present invention.

A magnet 340 is preferably connected to pedal 338. Twelve magnetic sensitive sensors 342 are preferably attached to device 276. When the magnet passes in their vicinity they react and preferably generate signals that will be preferably transferred to a computer (not shown in figure) via cable 344.

The signals correspond to the hours pattern marked on device 276, preferably or to angles Θ of the pedal's arm, where hour 12 is naturally at the upper end.

Note however, that we can preferably obtain the arm's angle Θ by several other methods, one of them being, e.g., to rely on signals and/or data retrieved from a "Polar" system.

Wherever "a system for measuring angle Θ" is referred to, it can preferably be any different matter than the one given above.

Preferably, a "static calibration" procedure is performed as follows: with the pedal at "hour 12" a line is marked, then pushing it to "hour 1", marking another line, and so on up to "hour 11". Marks are made by drawing a horizontal line respective to each "hour". For example, horizontal line 346 at "hour 12" in FIG. 24B and horizontal line 348 at "hour 3" in FIG. 25B.

As the experiments continue, when the beam passes next to said lines, the points [HOUR 12] and [HOUR 3], respectively, are marked.

Preferably, by the same procedure, the remainder of the points are marked, thus providing the set of points through which the results curve is drawn. In the real life experiments, it was possible—using said procedure—to identify and mark the extreme points of the curve.

Figure 25A:
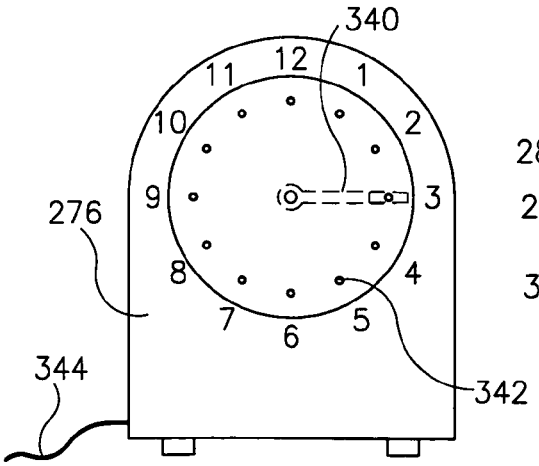
FIG. 25B: Shows a display panel with a record of the rider's movements (at hour 3).
Figure 25B:
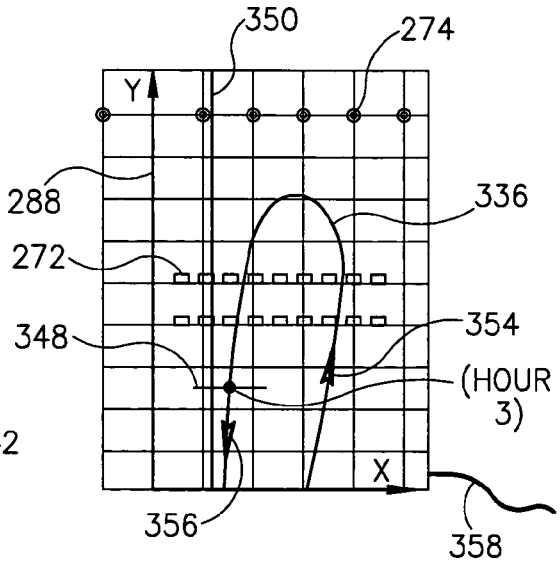

An orthogonal X-Y axes system for drawing the curves was constructed in FIGS. 24B and 25B.

The Y axis is the bicycles' center line 288.

In our experiments, we measured the distance between the rotation axes of the thighs at the rider's pelvis.

At the middle of this distance, in the X axis direction, the thighs' line 350 was marked. This line aids in estimating the distance of the knees from the central axis.

From FIG. 18 it is possible to understand that the projected movement of the knee in the X direction when marked on the vertical bristol cardboard 266, is shown on the target cardboard by a line approximately three fold longer in length (geometric result of similar triangles).

An extremity distance 352 from the Y axis expresses the maximal "moving away" of the knee in the X direction.

In the experiments, it was learned (see FIG. 24B) that width 353 of the curve in the X direction approximately expresses the maximal variance obtained in sideways movement in the X direction caused by the up and down movements of the knee.

The arrow 354 (FIG. 24B) designates the upward movement characterized by the range between "Hour 7" to "Hour 11".

The arrow 356 designates the downwards movement characterized by the range between "Hour 2" to "Hour 5".

Signals from sensors 272 are preferably transferred to the computer via cable 358, and in the opposite direction lighting one of the sensors 274 generates the signals that will be inputted to the computer.

The illuminated lamp presents to the rider an analog information (approximately) depicting the distance of the knee in the X direction, and enables him to improve his cycling performance.

Figure 26:
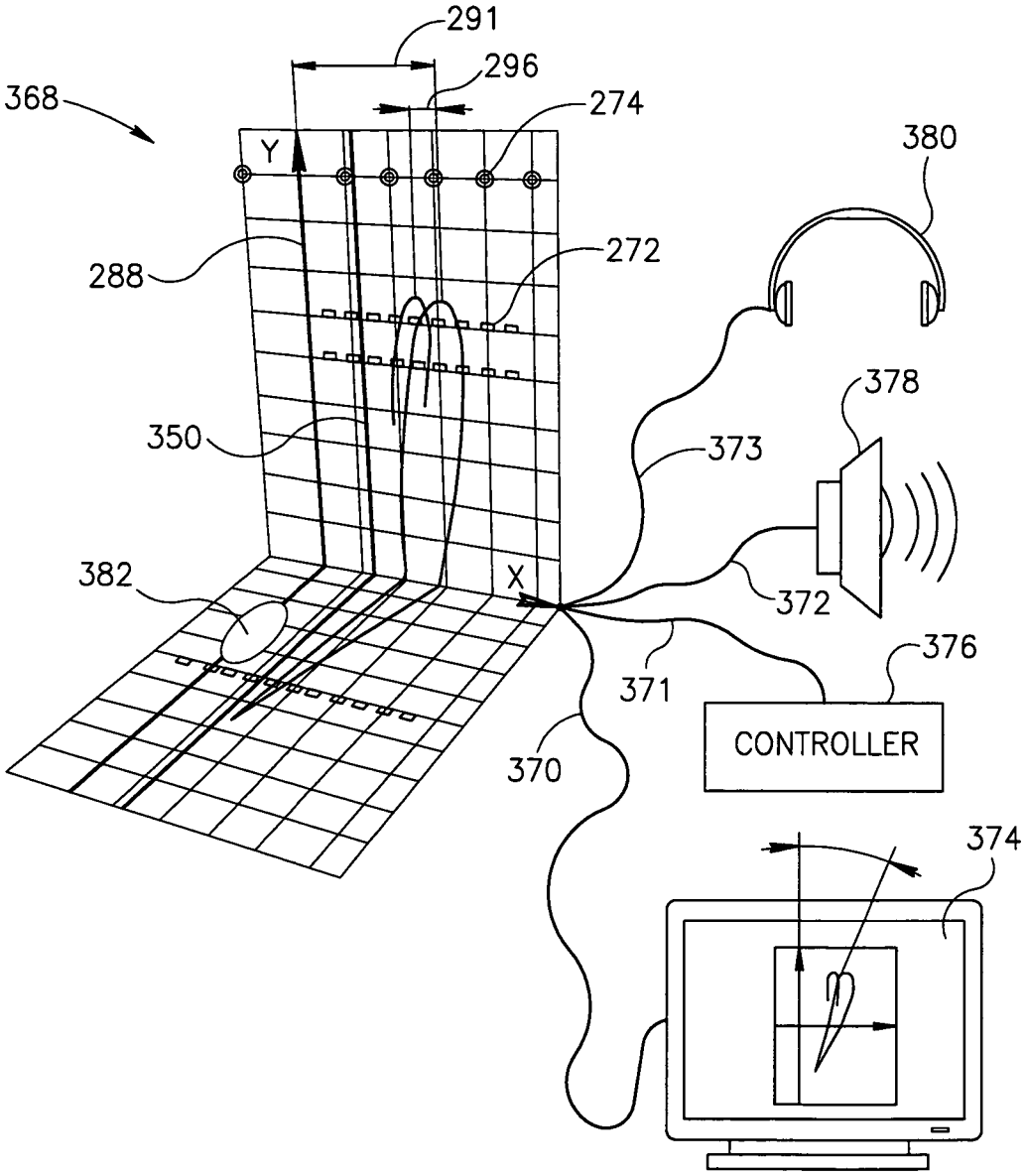
FIG. 26: Shows equipment for displaying the rider's movements, and earphones—mainly for providing bio feedback, and additional auxiliary implemets.

Reference is now made to FIG. 26 that illustrates an auxiliary system for rider 368, constructed and operative in accordance with a preferred embodiment of the present invention.

Using cables 370, 371, 372 and 373, one preferably interconnects all the electrical components of the auxiliary system for rider 368.

Signals arrive from sensors 272 and from device 276 (shown in FIG. 24A) via cable 334 (not seen in the figure) and transferred to the computer and monitor 374.

After being preferably processed by a suitable software program, the rider's movements can be displayed on the screen for him to understand.

Employing controller 376 together with appropriate commands from the computer, it is possible to light lamps 274.

Bio feedback to the rider can be preferably generated and passed to the rider by loudspeaker 378 and/or earphones 380, and/or light lamps 274, which expresses the position of the knee relative to the desired one, and thus helps him correct and improve his pedaling.

Preferably, an opening in cardboard 382 enables to place the bicycles front wheel on the floor without harmfully tearing up the cardboard.

Reference is now made to FIGS. 27A, 27B, 27C, 27D, 28A, 28B, 28C and 29 that present an arm and a pedal whose angle the rider can preferably change, constructed and operative in accordance with a preferred embodiment of the present invention.

Figure 27D:
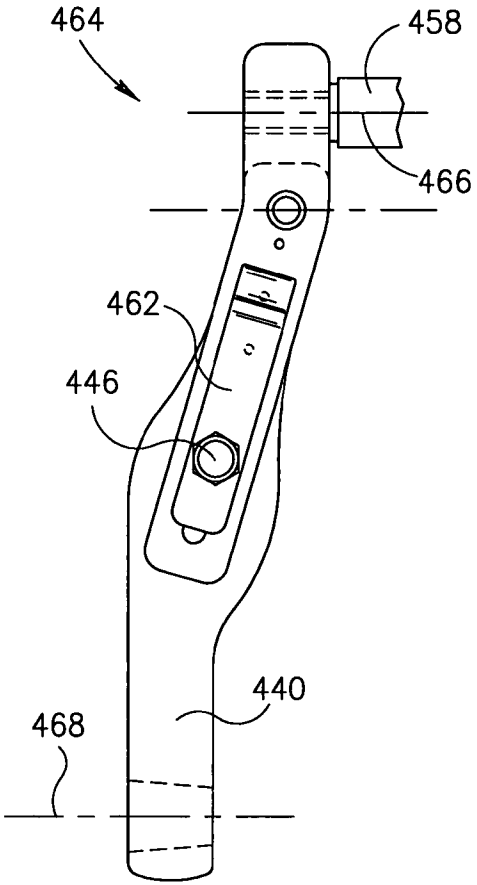
FIGS. 27A, 27B, 27C and 27D: Show a bicycle's arm intended for deflecting the pedal.
Figure 27C:
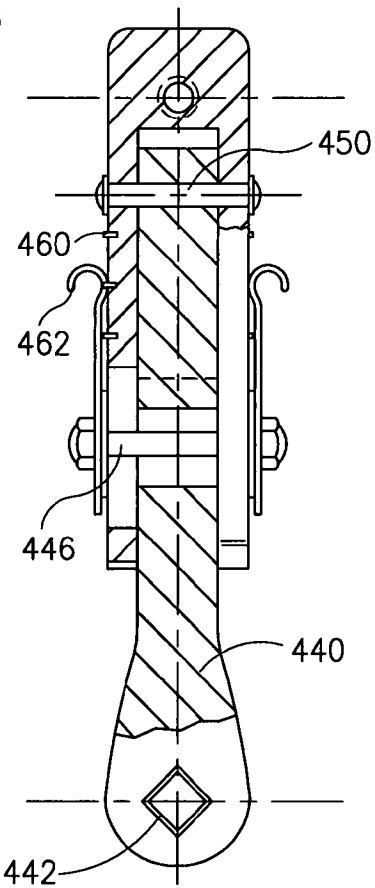
Figure 27B:
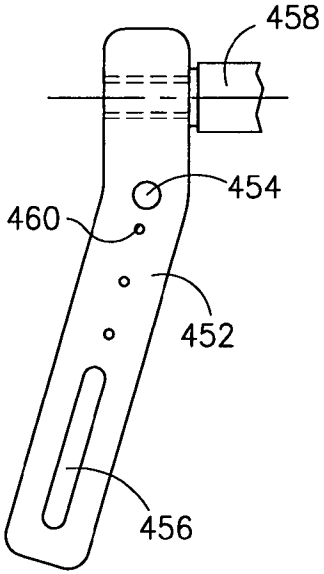
Figure 27A:
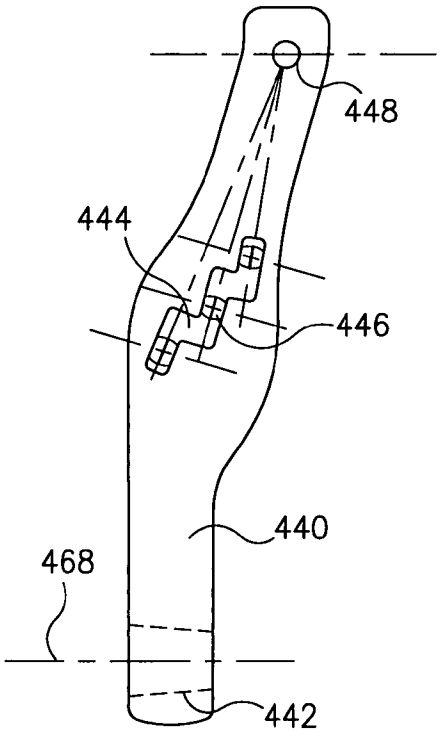

FIG. 27A presents the arm 440 that is connected to bicycles' axis (not shown in the figure).

The connection to the bicycles is preferably done through a square bore 442.

In the arm there exists a stepped groove 444.

Three possible states are preferably marked on the stepped groove 444, in which a movable pin 446 (see FIG. 29) might be found during pedaling (as will be explained below).

A "bore for rotation pin" 448, where rotation pin 450 in it constitutes a rotation axis for the revolving arm The revolving arm 452 turns around bore 454. In the revolving arm 452 there is preferably a length-wise groove 456 in which a preferably mobile pin 446 would travel, thus causing an angular tilt of the rotating arm 452 relative to arm 440. Tilting the rotating arm 452 tilts pedal 458 in the same angle.

Pins 460 located in three positions set the catch 462 in various states, each time in a different one.

Preferably, several other settings for positioning the pedals' angles—rather than the three positions shown in the figures discussed above, may also be made. For example 2, 4 or more. Preferably, a continuous variation of the angle is also a viable embodiment. FIG. 27D shows the pedal system 464 in the state at which the pedal's axis 466 is parallel to the axis 468 of the arms' rotation.

We designate this state as "the zero state" devoid of angular tilt. Hereinafter, the angular tilts would be referred to this zero state.

Figure 28C:
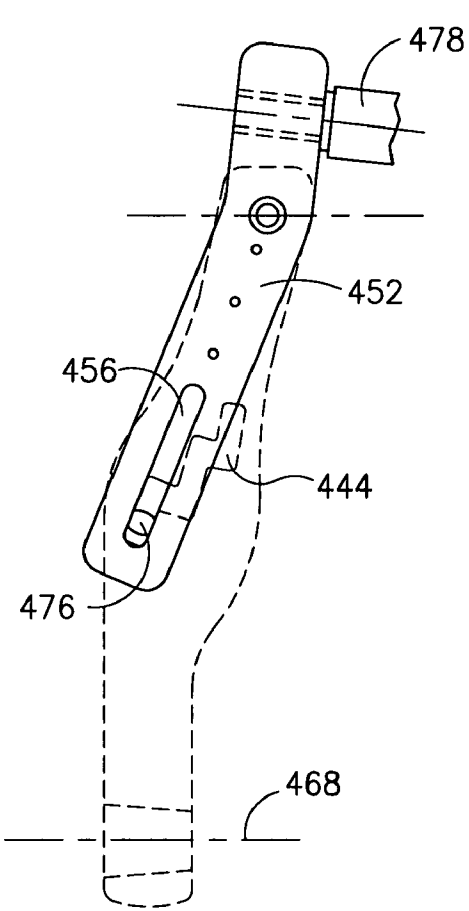
FIG. 28C: Shows an arm with pedal deflected downwards.
Figure 28B:
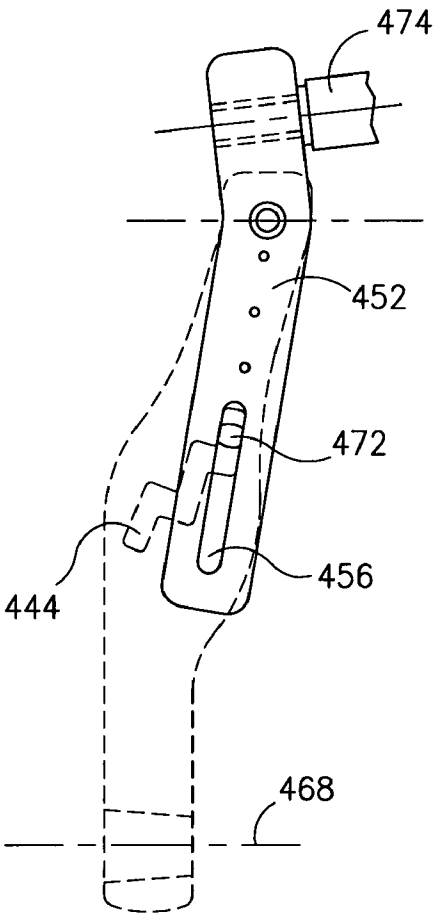
FIG. 28B: Shows an arm with pedal deflected upwards.
Figure 28A:
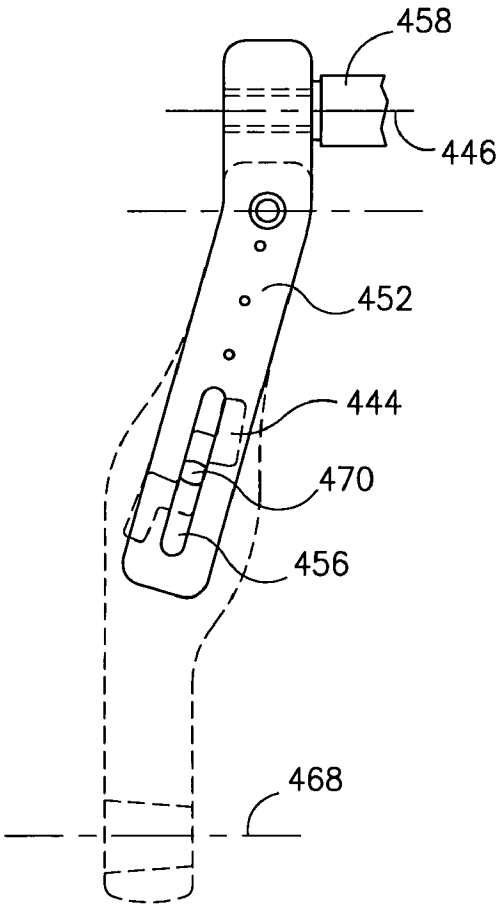
FIG. 28A: Shows an arm with pedal in its normal state.

FIGS. 28A, 28B and 28C focus on the rotating arm 452 at its different states.

In FIG. 28A, when the pin is in a central state, we receive the pedal "Tilt Zero" state as is also seen in FIG. 27D.

When the pin is moved, and the mobile pin is in TOP STATE 472, one preferably receives an upwards tilted pedal 474 as presented by FIG. 28B.

When the pin is moved, and the mobile pin is in BOTTOM STATE 476, one preferably receives a downwards tilted pedal 478.

Figure 29:
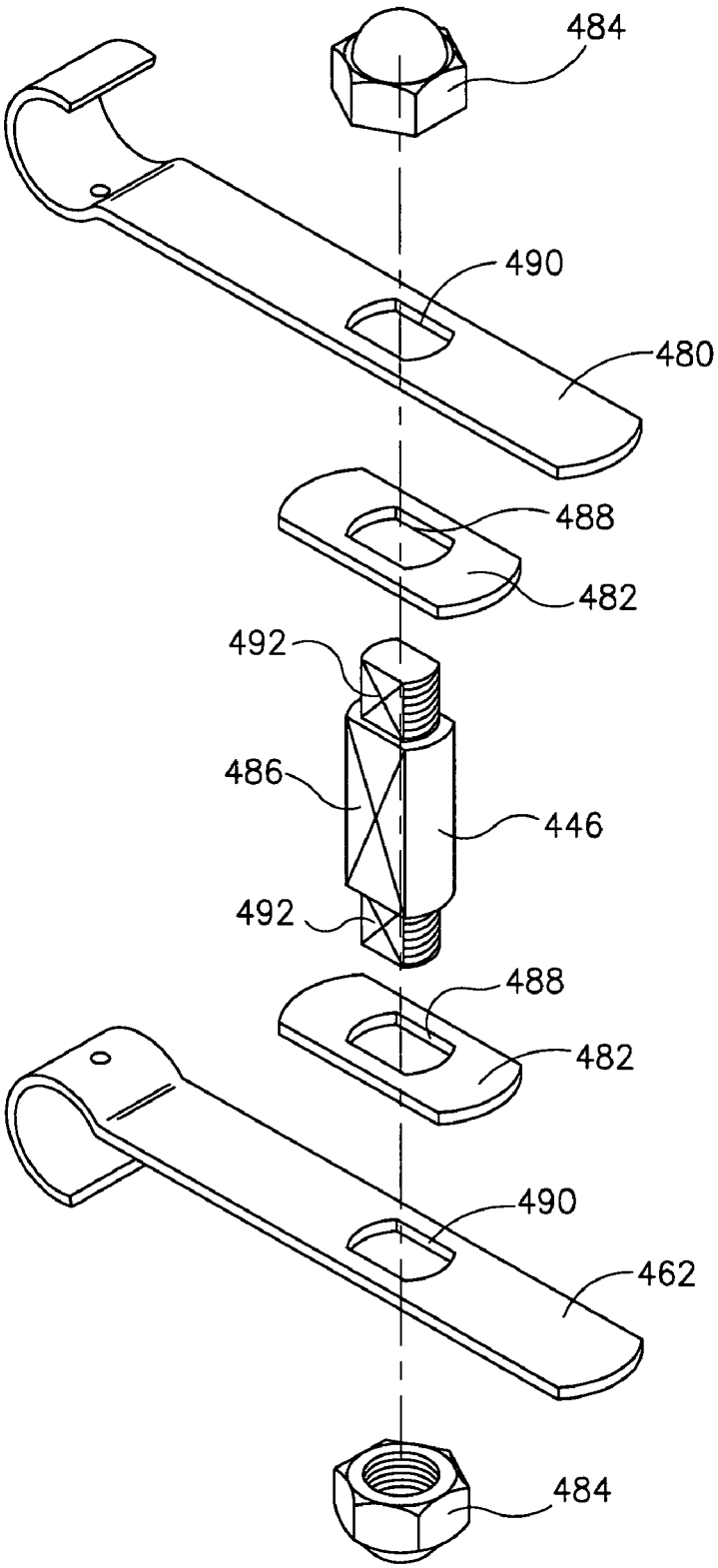
FIG. 29: Shows parts of the arm that varies the pedal's angle in exploded view.

In FIG. 29, the movable parts (with the pin) are seen together with the mobile pin 446. Positioning catch 462 preferably establishes the three states of the pedal 474. A springy slider 480 is a part parallel to positioning catch 462. Auxiliary plates 482 stabilize the mobile pin 446. Nuts 484 closes the parts of the movable pin 446 at its two sides. Elongated grooves 488 in the parts 482 set themselves on surfaces 486 of the movable pin 446. Elongated grooves 490 set the localizing catch 462 and springy slider 480 relative to pin 446 aided by surfaces 492.

It will be appreciated by persons skilled in the art that the present invention is not limited by what has been particularly shown and described hereinabove.

Rather the scope of the present invention includes both combinations and sub-combinations of the various features described hereinabove as well as variations and modifications which would occur to persons skilled in the art upon reading the specifications and which are not in the prior art.

The invention claimed is:

1. A pedal assembly comprising:

a pedal, and a crank arm having an axis of rotation; and a variable attachment device that attaches said pedal to said crank arm at an angle of inclination with respect to said axis of rotation of said crank arm, wherein said variable attachment device comprises a rotating part to which said pedal is attached, said rotating part being rotatably attached to a point on said crank arm distanced along a longitudinal axis of said crank arm from said axis of rotation of said crank arm, said rotating part being rotatable about a rotation axis which is generally perpendicular to said axis of rotation of said crank arm and generally perpendicular to said longitudinal axis, and wherein rotating said rotating part about said rotation axis relative to said crank arm changes said angle of inclination with respect to said axis of rotation of said crank arm, and wherein an angle of said pedal with respect to a horizontal ground surface changes during pedaling of said pedal about said axis of rotation of said crank arm.

2. The pedal assembly according to claim 1, wherein said rotation axis comprises a rotation pin that passes through a bore formed in said arm and a bore formed in said crank arm.

3. The pedal assembly according to claim 1, wherein said angle of inclination with respect to said axis of rotation of said crank arm is fixed by tightening at least two parts to one another.

4. The pedal assembly according to claim 1, further comprising an adjustment device operative to adjust an angle of an upper surface of said pedal with respect to an axis of rotation of said pedal.

5. The pedal assembly according to claim 4, wherein said adjustment device operative comprises a mechanical fastener passing through a slot that secures the upper surface to said pedal.

6. The pedal assembly according to claim 1, wherein said crank arm and said rotating part remain fixed to each other during pedaling of said pedal.

7. The pedal assembly according to claim 1, wherein pedaling said pedal defines a cone having a conical angle equal to said angle of inclination with respect to said axis of rotation of said crank arm.

8. A pedal assembly comprising:

a pedal, and a crank arm having an axis of rotation; and a variable attachment device that attaches said pedal to said crank arm at an angle of inclination with respect to said axis of rotation of said crank arm, wherein said variable attachment device comprises an arm to which said pedal is attached, said arm being rotatably attached to said crank arm at a rotation axis that passes through said arm and said crank arm, and wherein rotating said arm relative to said crank arm changes said angle of inclination with respect to said axis of rotation of said crank arm, wherein said arm has a first groove formed therein and said crank arm is formed with a second groove, and a movable pin passes through said first and second grooves, and wherein moving said movable pin to different positions in said first and second grooves causes an angular tilt of said arm relative to said crank arm, thereby changing said angle of inclination with respect to said axis of rotation of said crank arm.

9. The pedal assembly according to claim 8, wherein said second groove of said crank arm comprises a stepped groove.

10. The pedal assembly according to claim 8, wherein said movable pin is attached to a positioning catch, and said positioning catch catches on to said arm at different angular tilts of said arm relative to said crank arm.

* * * * *